US006537127B1

(12) United States Patent
Lund et al.

(10) Patent No.: US 6,537,127 B1
(45) Date of Patent: Mar. 25, 2003

(54) KISSING DOLL

(75) Inventors: Bruce D. Lund, Chicago, IL (US); Krishnan Srirangam, Chicago, IL (US); Michael Starrick, Maywood, IL (US)

(73) Assignee: LUND and Company, Chicago, IL (US)

( * ) Notice: Subject to any disclaimer, the term of this patent is extended or adjusted under 35 U.S.C. 154(b) by 0 days.

(21) Appl. No.: 10/228,377

(22) Filed: Aug. 27, 2002

(51) Int. Cl.[7] ..... A63H 3/28; A63H 3/36
(52) U.S. Cl. ..... 446/300; 446/395
(58) Field of Search ..... 446/268, 300, 446/298, 297, 352, 353, 395

(56) References Cited

U.S. PATENT DOCUMENTS 3,846,934 A * 11/1974 Thorn et al. ..... 446/191
4,126,960 A * 11/1978 Guerrero ..... 446/190
4,170,841 A * 10/1979 Sullivan et al. ..... 446/395
5,466,181 A * 11/1995 Bennett et al. ..... 446/297

* cited by examiner

*Primary Examiner*—Jacob K. Ackun

(57) ABSTRACT

In one embodiment the kisses that the doll may perform are "raspberry kisses", "eskimo kisses" and regular kisses. To simulate a raspberry kiss a motor mechanism in the mouth of the doll causes the lips to vibrate, which causes a child to feel a tingling sensation when the child presses against the vibrating lips. To simulate an eskimo kiss the motor mechanism alternatively causes the head of the doll to move side-to-side, which when a child places their nose up against the doll's nose causes a rubbing feeling. The doll also includes a speaker to emit various sounds that coincide with the kisses. The doll will also give regular kisses that do not use the motor mechanism and are simply a kissing sound that emanates from the speaker. Various sensors or mechanical switches are used to activate the various kisses and sounds.

18 Claims, 2 Drawing Sheets

KISSING DOLL

BACKGROUND OF THE INVENTION

The particular invention relates to dolls that give kisses. Dolls have always been the mainstay as a toy for young children. There have been numerous varieties of dolls from no interaction to fully interactive dolls. There exist dolls that speak, cry, sing and laugh in response to a child touching or squeezing various parts of the doll, as well as dolls that walk and crawl. However, there are always a continual need for improvements and new and novel features.

SUMMARY OF THE INVENTION

In accordance with the present invention a doll is provided that gives various kisses to a user. In one embodiment the kisses that the doll may perform are "raspberry kisses", "eskimo kisses" and regular kisses. To simulate a raspberry kiss a motor mechanism in the mouth of the doll causes the lips to vibrate, which causes a child to feel a tingling sensation when the child presses against the vibrating lips. To simulate an eskimo kiss the motor mechanism alternatively causes the head of the doll to move side-to-side, which when a child places their nose up against the doll's nose causes a rubbing feeling. The doll also includes a speaker to emit various sounds that coincide with the kisses. The doll will also give regular kisses that do not use the motor mechanism and are simply a kissing sound that emanates from the speaker. Various sensors or mechanical switches are used to activate the various kisses and sounds.

Numerous other advantages and features of the invention will become readily apparent from the following detailed description of the invention and the embodiments thereof, from the claims, and from the accompanying drawings.

BRIEF DESCRIPTION OF THE DRAWINGS

A fuller understanding of the foregoing may be had by reference to the accompanying drawings, wherein.

DETAILED DESCRIPTION OF THE EMBODIMENTS

Figure 1:
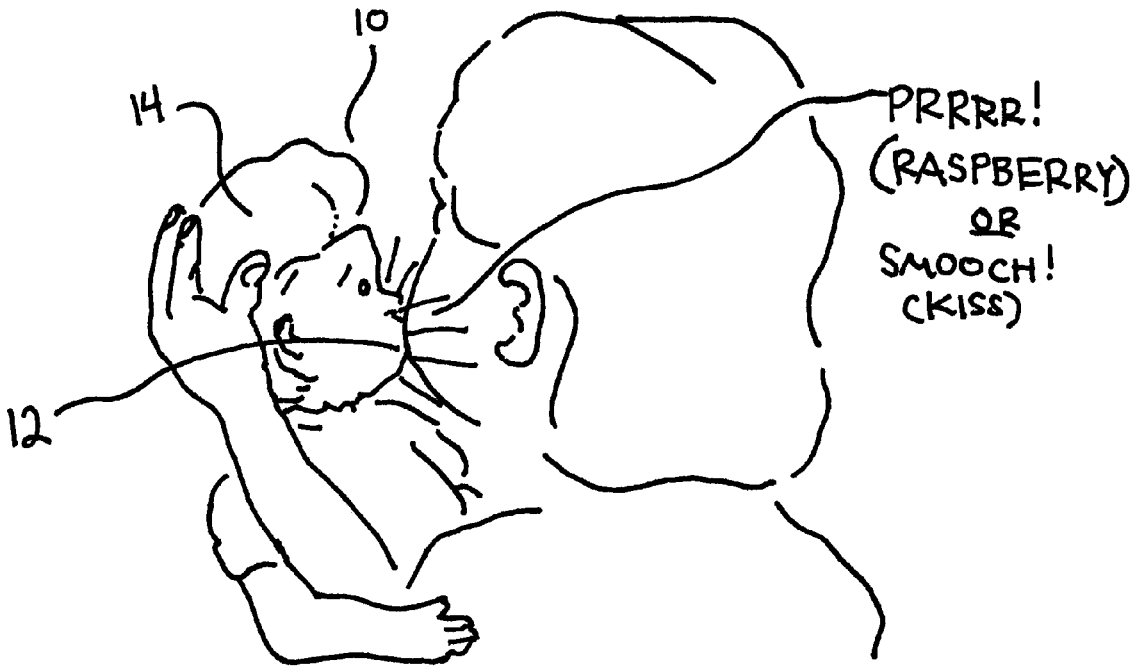
FIG. 1 illustrates a user holding and kissing a kissing doll in accordance with the present invention where the doll is giving raspberry or regular kisses.

While the invention is susceptible to embodiments in many different forms, there are shown in the drawings and will be described herein, in detail, the preferred embodiments of the present invention. It should be understood, however, that the present disclosure is to be considered an exemplification of the principles of the invention and is not intended to limit the spirit or scope of the invention and/or claims of the embodiments illustrated.

Figure 2:
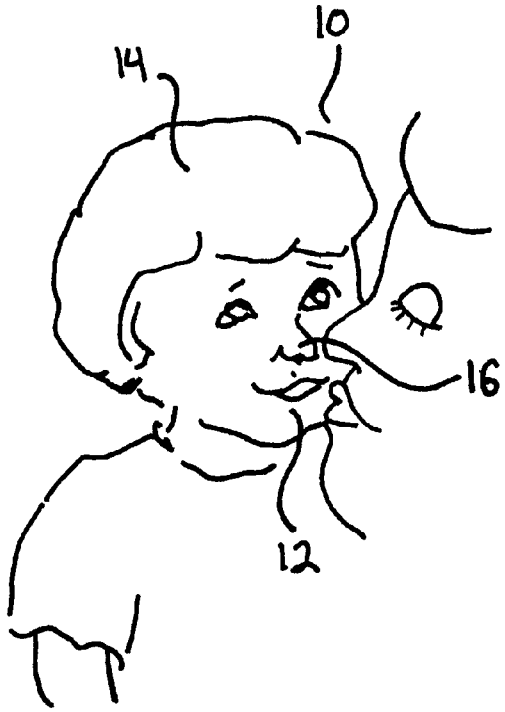
FIG. 2 illustrates a user holding and kissing a kissing doll in accordance with the present invention where the doll is giving eskimo kisses.

Referring now to the Figures, there is shown a doll 10 being held by a user or child (FIGS. 1 and 2). The doll 10 in accordance with the present invention is giving the child a kiss. While there are various types of kisses, the present invention may perform raspberry kisses, eskimo kisses or regular kisses.

As shown in FIG. 1 the doll 10 is giving the child a raspberry kiss or a regular kiss. Raspberry kisses are performed by a motor mechanism 20 (FIG. 3) that causes a slight vibration on the lips 12 of the doll 10. The vibration of the lips 12 when pressed up against a person's skin creates a tingling sensation which simulates a raspberry kiss. A regular kiss is performed by emanating the sound of a kiss; as such there is no need for movement of the doll 10 to perform a regular kiss. The regular kiss may be triggered by a switch in the moth such as an optical or pressure switch.

As shown in FIG. 2 the doll 10 is giving the child an eskimo kiss. Eskimo kisses are kisses where two people rub their noses together. To perform the eskimo kiss the motor mechanism 20 rotates the head 14 of the doll side-to-side. When a child presses their nose against the nose 16 of the doll 10 and the head 14 of the doll 10 is moving side-to-side, the child's nose and the nose 16 of the doll rub against each other thus the doll 10 is giving the child an eskimo kiss.

Various sensors or mechanical switches are employed, discussed in greater detail below, to activate the various kisses and sounds from the doll 10. In addition, the doll 10 upon activation may randomly give any type of kiss. After performing or giving a kiss, the doll 10 may need to be activated again by the child or may be programmed to cycle through a series of kisses and sounds. After which the doll 10 may be required to be activated again by the switches or sensors.

Figure 3:
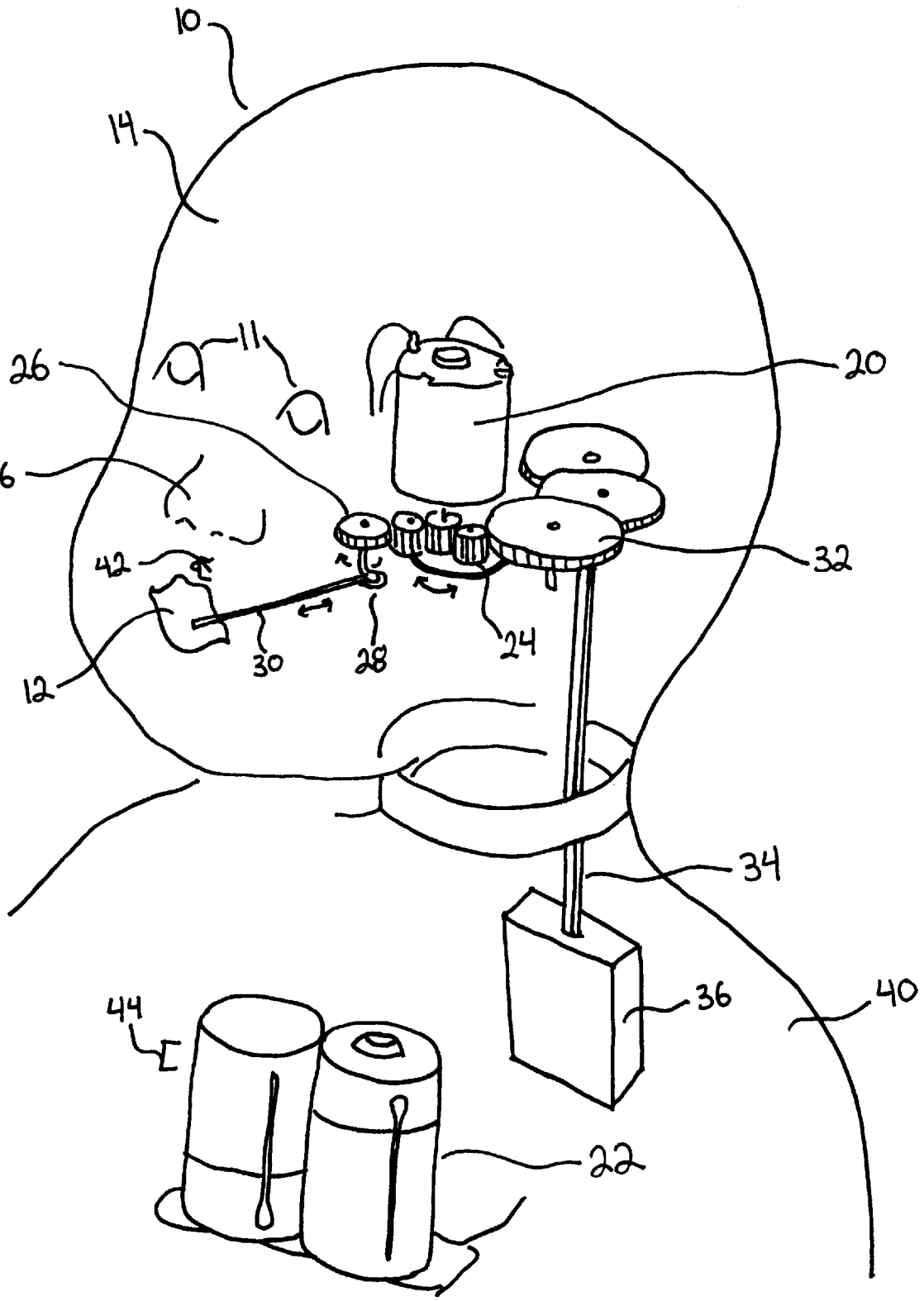
FIG. 3 depicts the kissing doll from FIGS. 1 and 2.

Referring now to FIG. 3, the doll 10 in accordance with the present invention is partially illustrated. Some of the external features of the doll 10 have been removed for clarity purposes only, and do not impact upon the scope of the present invention. The doll 10 includes a head 14 that is pivotally attached to a torso 40. The head 14 includes typical features associated with a baby, such as eyes 11, lips 12, nose 16 and ears (not shown). It should further be noted that such features may be altered and changed to denote other types of fictitious creatures.

The doll 10 includes a motor mechanism 20 that is powered by a power supply 22 and is in communication with a swing gear 24. When the motor mechanism 20 is operating in one direction (for example forwards) the swing gear 24 engages a mouth gear 26. As the mouth gear 26 rotates it turns a link 28 that laterally moves a pin 30. As the pin 30 moves laterally outwardly it presses against an inside portion of the lips 12, which causes the lips 12 to vibrate. As mentioned above, when a child presses against the vibrating lips 12, the child feels a tingling sensation that simulates a raspberry kiss. Alternatively, a raspberry kiss may be performed by mounting a speaker against the inside portion of the lips 12 and emanating a specific sound at a certain frequency.

Continuing to refer to FIG. 3, when the motor mechanism 20 is operating in another direction (for example reverse) the swing gear 24 disengages the mouth gear 26 and slides to a second position to engage a head gear train 32. The head gear train 32 is in communication with a cam (not shown) that is mounted in the head 14 and that reciprocates laterally when the head gear train 32 rotates. The cam is also meshed to a shaft 34, which is secured to an anchor 36 in the torso 40. As such when a child is holding the torso 40 still and the head gear train 32 begins to rotate the cam, the lateral reciprocating motion of the cam against the shaft 34 will cause the head 14 to move side-to-side. Since the side-to-side motion of the head is relative to the torso 40, if the child was holding the head 14 of the doll 10 still, the torso 40 would laterally move side-to-side.

As mentioned above various switches and/or sensors are employed to activate the doll 10. For example an optical sensor 42 may be employed about the lips 14. When a child presses against the lips 14 the optical sensor 42 will be covered such that the doll 10 can determine and perform a raspberry or regular kiss. In addition or alternatively, a mechanical switch 44 may be located in the torso 40 of the doll 10. When a user presses the mechanical switch 44 the doll 10 can determine and perform an eskimo kiss. Moreover because the optical sensor 42 is also covered when the doll 10 is performing an eskimo kiss, the mechanical switch 44 when depressed may also de-activate the optical sensor 42 such that the doll 10 will only perform the eskimo kiss.

In addition a speaker (not shown) is employed to play various pre-programmed sounds, phrases and or noises that relate to the kisses. The doll 10 also includes a circuit board (not shown) in order to control the motor mechanism in response to the sensors and switches as well as to control the audio response emanating from the speaker.

It is further included in the present invention that the doll 10 may only give one specific kiss. For example, the doll 10 may only give eskimo kisses or only give raspberry kisses. In such embodiments the swing gear would not be necessary.

From the foregoing and as mentioned above, it will be observed that numerous variations and modifications may be effected without departing from the spirit and scope of the novel concept of the invention. It is to be understood that no limitation with respect to the specific methods and apparatus illustrated herein is intended or should be inferred. It is, of course, intended to cover by the appended claims all such modifications as fall within the scope of the claims.

We claim:

1. A raspberry kiss doll comprising:

a head connected to a torso, the head includes at least a nose and lips;

a means to vibrate the lips, such that when activated the lips vibrate; and a means to activate the vibrating means in the lips, wherein when a user activates the vibrating means and presses against the vibrating lips the user feels a tingling sensation.

2. The doll of claim 1, wherein the means to vibrate the lips includes a motor mechanism in communication with a pin such that when the motor mechanism is operating the pin reciprocally pushes against the lips, causing the lips to vibrate.

3. The doll of claim 1, wherein the means to vibrate the lips includes mounting a speaker against the lips and emanating a sound at a frequency that causes the lips to vibrate.

4. The doll of claim 2, wherein the means to activate the vibrating means includes a sensor placed about the lips, the sensor being triggered to activate the vibrating means when a user approaches the lips.

5. The doll of claim 1 further comprising:

a pivotal connection between the head and torso; and a mechanical means to pivot the head side-to-side when activated.

6. The doll of claim 5 including a motor mechanism in communication with a swing gear, the motor mechanism causes the swing gear to engage the lip vibrating means when rotating in a first direction and causes the swing gear to engage the head pivoting means when rotating in a second direction.

7. The doll of claim 6, wherein the lip vibrating means includes a mouth gear in communication with a pin, the pin reciprocally moves against the lips when the mouth gear is engaged by the swing gear.

8. The doll of claim 6, wherein the head pivoting means includes a head gear train in communication with a cam, the cam reciprocally moves the head side-to-side when the head gear train is engaged by the swing gear.

9. The doll of claim 6 further comprising a mechanical activation switch located in the torso, the mechanical activation switch when triggered causes the head to pivot side-to-side.

10. A kissing doll comprising:

a head pivotally connected to a torso, the head includes at least a nose and lips;

a means to vibrate the lips, such that when activated the lips vibrate;

a mechanical means to pivot the head that when activated pivots the head side-to-side, and a means to activate the vibrating means in the lips, wherein when a user activates the vibrating means and presses against the vibrating lips the user feels a tingling sensation and a means to activate the head pivoting means, wherein when a user activates the head pivoting means and presses against the nose the nose rubs against the user in a side-to-side motion.

11. The doll of claim 10, including a motor mechanism in communication with a swing gear, the motor mechanism causes the swing gear to engage the lip vibrating means when rotating in a first direction and causes the swing gear to engage the head pivoting means when rotating in a second direction.

12. The doll of claim 11, wherein the lip vibrating means includes a mouth gear in communication with a pin, the pin reciprocally moves against the lips when the mouth gear is engaged by the swing gear.

13. The doll of claim 11, wherein the head pivoting means includes a head gear train in communication with a cam, the cam reciprocally moves the head side-to-side when the head gear train is engaged by the swing gear.

14. The doll of claim 12, wherein the means to activate the vibrating means includes a sensor placed about the lips, the sensor being triggered to activate the vibrating means when a user approaches the lips.

15. The doll of claim 13 further comprising a mechanical activation switch located in the torso, the mechanical activation switch when triggered causes the head to pivot side-to-side.

16. The doll of claim 10 further comprising a speaker to emanate different pre-programmed sounds relating to kisses.

17. A kissing doll comprising:

a head pivotally connected to a torso, the head includes at least a nose and lips;

a motor mechanism in communication with a head gear train and controlled by a circuit board;

a cam in communication with the head gear train, the cam reciprocally moves the head side-to-side when the head gear train is rotated by the motor mechanism;

an optical sensor positioned in the head and in communication with the circuit board, such that when the optical sensor is activated by a user, the circuit board pivots the head side-to-side such that when the user presses against a nose defined on the doll, the nose rubs against the user in a side-to-side motion imitating an eskimo kiss; and a speaker to emanate different pre-programmed sounds relating to said eskimo kiss.

18. The doll of claim 17, further comprising:

a swing gear in communication with the motor mechanism such that the motor mechanism causes the swing gear to engage a mouth gear when rotating in a first direction and causes the swing gear to engage the head gear when rotating in a second direction; and a rod in communication with the mouth gear, the rod reciprocally moves against the lips when the mouth gear is engaged by the swing gear to vibrate the lips, such that when a user presses against the vibrating lips the user feels a tingling sensation, wherein the means to activate the vibrating means includes a sensor placed about the lips, the sensor being triggered to activate the vibrating means when a user approaches the lips.

* * * * *